United States Patent [19]

Hays et al.

[11] 4,057,230

[45] Nov. 8, 1977

[54] DIE QUENCH MACHINE AND METHOD

[75] Inventors: Raymond H. Hays; Kenneth D. Gladden, both of East Peoria, Ill.

[73] Assignee: Caterpillar Tractor Co., Peoria, Ill.

[21] Appl. No.: 663,593

[22] Filed: Mar. 3, 1976

[51] Int. Cl.[2] ..... C21D 1/66; C21D 9/30

[52] U.S. Cl. ..... 266/117; 134/149; 148/131; 266/125; 266/134

[58] Field of Search ..... 134/149, 201; 148/131, 148/153; 266/117, 125, 134; 219/10.67, 10.73

[56] References Cited

U.S. PATENT DOCUMENTS

| | | | |
|---|---|---|---|
| 3,210,223 | 10/1968 | Good | 266/117 X |
| 3,447,547 | 6/1969 | Sansom et al. | 266/117 X |
| 3,506,501 | 4/1970 | Hays et al. | 148/131 |
| 3,589,697 | 6/1971 | Hays et al. | 266/117 |
| 3,702,693 | 11/1972 | Balzer | 266/125 |
| 3,854,707 | 12/1974 | Armstrong et al. | 266/125 |

*Primary Examiner*—Roy Lake
*Assistant Examiner*—Paul A. Bell
*Attorney, Agent, or Firm*—Phillips, Moore, Weissenberger, Lempio & Majestic

[57] ABSTRACT

The invention is concerned with a horizontally closing die quenching apparatus and with a method for die quenching. The apparatus comprises a pair of relatively movable opposed substantially vertical platens each supporting a plurality of die blocks, the die blocks each having an internal cavity and generally opposed outer surfaces for receiving and substantially surrounding a plurality of first selected portions of a work piece when the platens are moved together. The die blocks also include a plurality of relatively small fluid passageways extending through the opposed surfaces thereof the passageways providing fluid communication with the cavities within the die blocks. A plurality of opposed fixtures are provided movable together relative to the platens for holding the work piece at its ends between the die blocks and means are provided for controllably pressuring the fixtures towards one another. The die quenching method comprises holding a heated work piece under a pressure insufficient to cause distortion thereof between a pair of horizontally separated fixtures, forming a chamber about the work piece with die blocks extending thereinto supporting the work piece and preventing distortion thereof, substantially simultaneously increasing the pressure between the fixtures sufficiently to prevent the work piece from distorting by forcing them further apart and spraying a quench liquid through a plurality of small passageways in the die blocks on to first selected portions of the work piece and then flooding the chamber with quench liquid.

8 Claims, 5 Drawing Figures

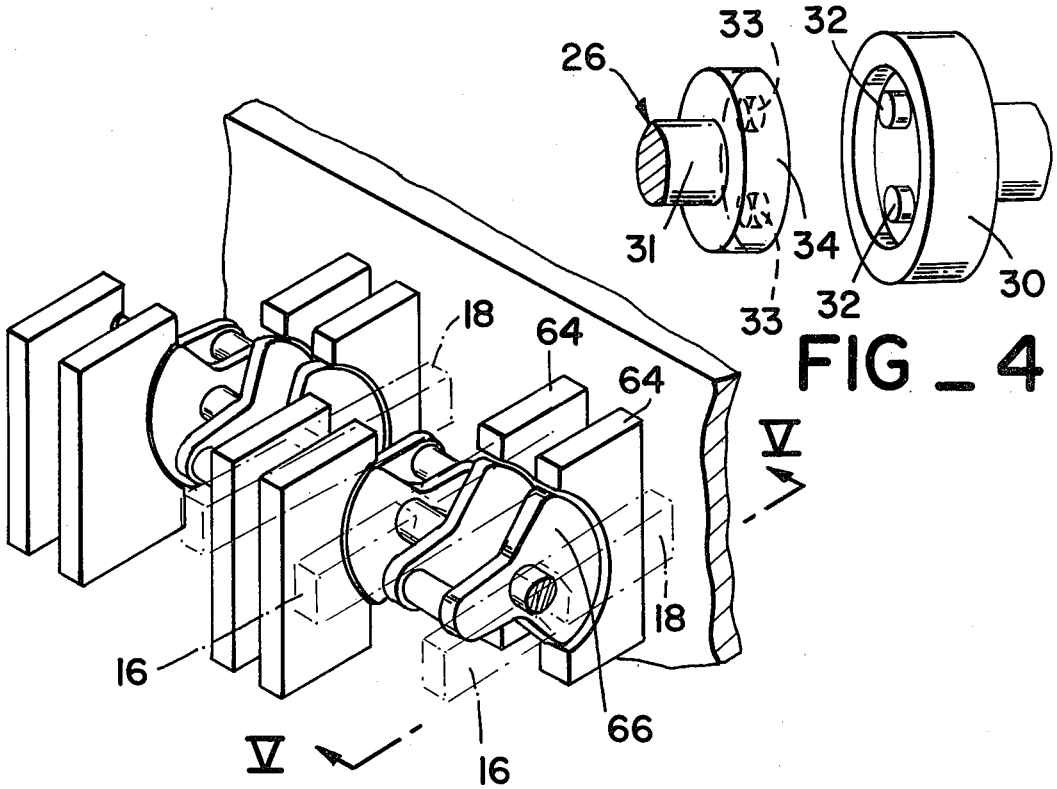
FIG _ 4
FIG _ 3
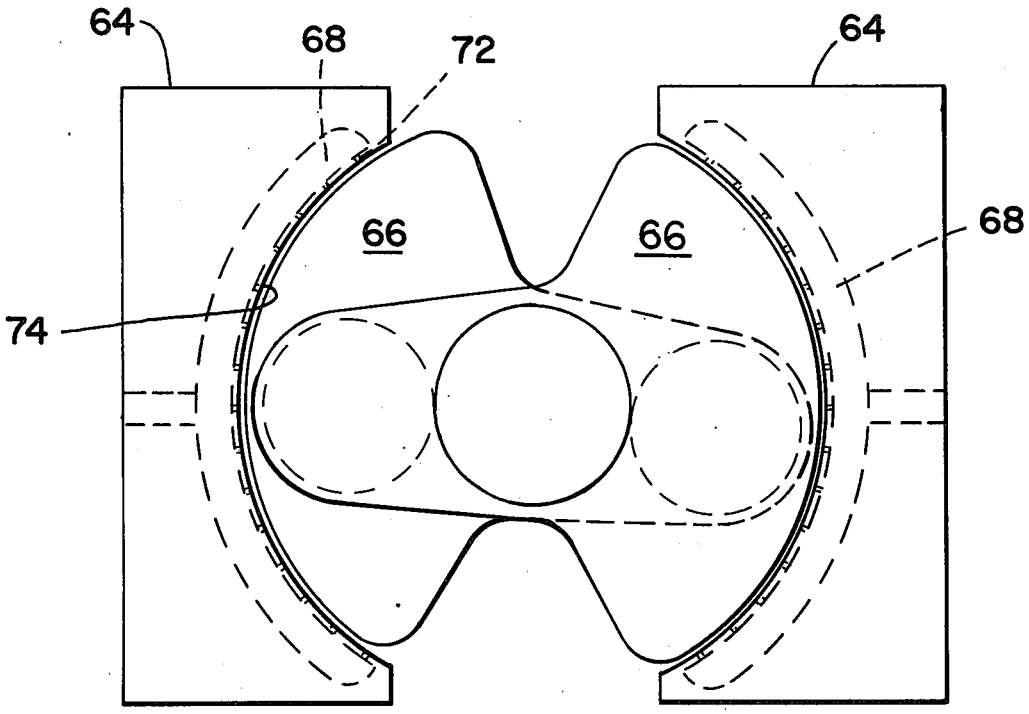
FIG _ 5

DIE QUENCH MACHINE AND METHOD

BACKGROUND OF THE INVENTION

1. Field of the Invention

The invention is concerned with the art of controllably quench hardening work pieces such as crankshafts and the like.

2. Prior Art

Prior art die quenching equipment has generally consisted of a pair of platens which are vertically displaced from one another. In such apparatus a work piece such as a crankshaft or the like has generally been placed on the lower platen and supported thereby and then the upper platen has been propelled towards the lower platen to form a chamber about the crankshaft whereupon quenching has proceeded as by spraying liquid or the like on to portions of the work piece which are to be made especially hard. Generally, a flood of quench liquid has been added to the chamber shortly after the spraying of the quench liquid has begun. Typical die quenching apparatus and methods operating generally as described above are described in considerably more detail in each of U.S. Pat. Nos. 3,447,547; 3,506,501; 3,589,697; and 3,854,707. The latter patent is particularly concerned with inductively heating and quench hardening the bearing surface of a crankshaft.

A serious problem has existed with prior art apparatus and methods for die quenching of work pieces. In particular, when the work piece is placed upon the lower platen of two vertically separated platens it immediately begins to slowly cool at its points of contact with the lower platen. While the degree of pre-cooling can be minimized as taught for example in U.S. Pat. Nos. 3,506,501 and 3,589,697 it has been found that the obtaining of a uniform hardened bearing surface on a work piece is generally deleteriously affected by its sitting upon the lower platen. This can lead to soft spots and/or distortion of the work piece under heavy load conditions.

The present invention provides a solution to the above-mentioned problem. In particular, the present invention provides a die quench apparatus and method wherein horizontally separated vertical platens replace the prior art vertically separated horizontal platens and where, hence, the work piece never sits upon a lower platen. Even more particular, the work piece never sits for any even slightly extended length of time against any platen before quenching is begun.

SUMMARY OF THE INVENTION

In one sense, the invention comprises die quenching apparatus which comprises a pair of relatively movable opposed substantially vertical platens; a plurality of die blocks supported on a first of said platens; a corresponding plurality of die blocks supported on a second of said platens for mating co-operation with said first platen die blocks, said first and second die blocks each having an internal cavity and further having generally opposed outer surfaces for receiving and substantially surrounding a plurality of first selected portions of a work piece when said platens are moved toward each other. A plurality of relatively small fluid passageways is provided extending through the opposed surfaces of the die blocks, the passageways providing fluid communication with the die block cavities. A plurality of opposed fixtures are provided movable together relative to the platens for holding the work piece at its ends between the die blocks and means are provided for pressuring the fixtures towards one another.

In another sense the invention comprises a method for die quenching a work piece. The method comprises holding a heated work piece under a pressure insufficient to cause distortion thereof between a pair of fixtures, forming a chamber about the work piece with die blocks extending thereinto supporting the work piece at a plurality of first selected portions thereof and preventing distortion thereof, increasing the pressure between the fixtures sufficiently to prevent the work piece from forcing them further apart, spraying a quench liquid through a plurality of small passageways in the die blocks on to said first selected portions of the work piece and flooding the chamber with quench liquid.

BRIEF DESCRIPTION OF THE DRAWINGS

The invention will be better understood by reference to the figures of the drawings wherein like numbers denote like parts throughout and wherein:

FIG. 3 illustrates in further enlarged view in perspective and cut away the area III—III of FIG. 2 and most particularly the air anneal features in this area.

FIG. 4 illustrates, in side section, a detail in the apparatus of the present invention; and FIG. 5 illustrates a mirror image of a view taken from the plane V—V of FIG. 3.

DETAILED DESCRIPTION OF THE PREFERRED EMBODIMENT

Figure 1:
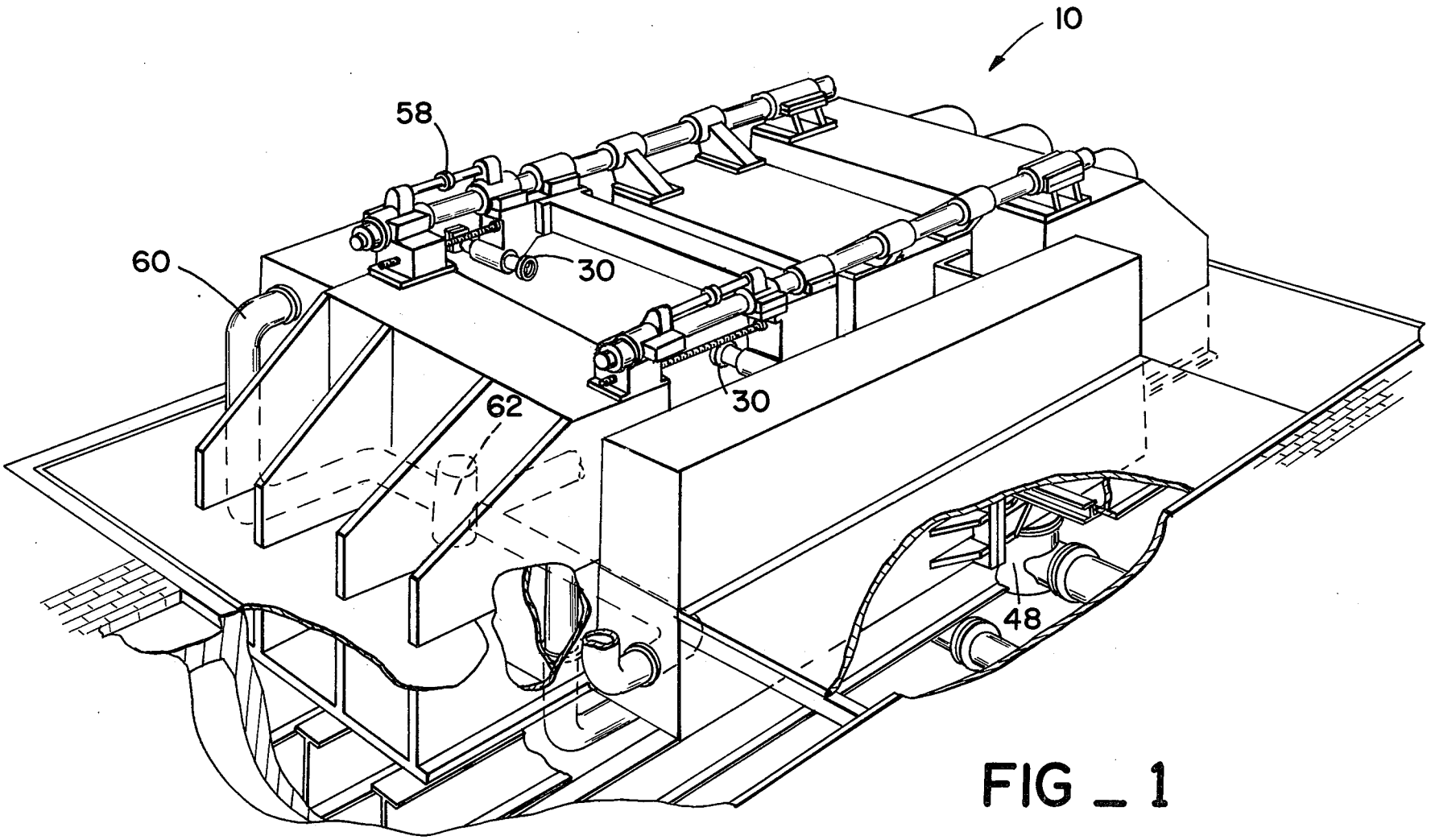
FIG. 1 illustrates in partially cut away perspective, a die quenching apparatus of the present invention.
Figure 2:
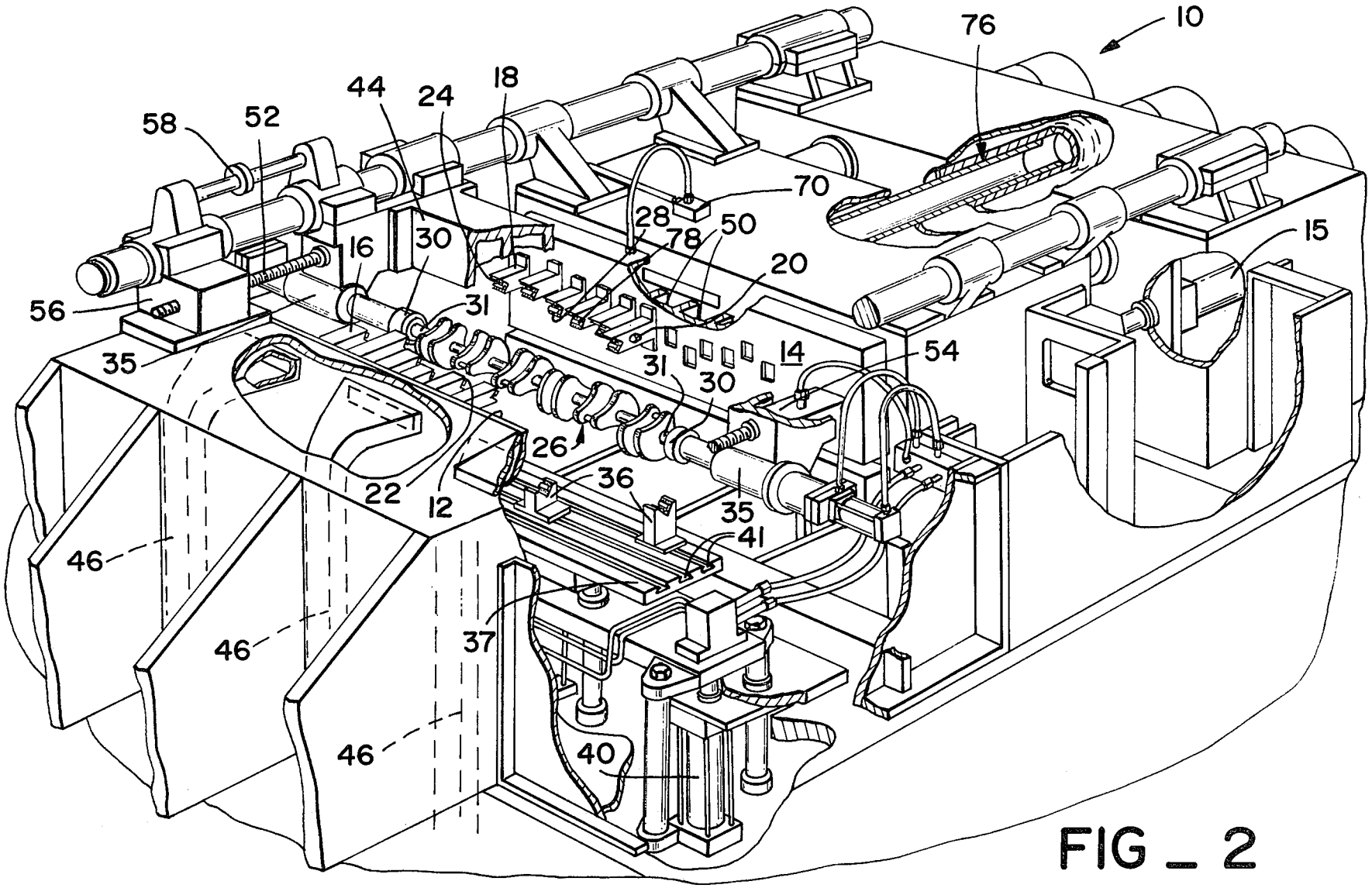
FIG. 2 illustrates, in enlarged view in perspective, greatly cut away, a portion of a die quenching apparatus of the present invention and a crankshaft held therein with the platens separated with the air anneal features omitted for clarity.

Referring now to the drawings a die quench apparatus 10 is illustrated. The die quench apparatus 10 includes a pair of substantially vertical platens 12 and 14 with the platen 12 being fixed in position and the platen 14 being movable relative thereto under the impetus of motor means, e.g., a pair of hydraulic cylinders 15 one of which is shown in FIG. 2. Extending from the platen 12 are a plurality of die blocks 16. The plurality of die blocks 16 extends towards a corresponding second plurality of die blocks 18 on the platen 14. It will be noted that the plurality of die blocks 18 is supported on the platen 14 for mating co-operation with the plurality of die blocks 16 on the platen 12. Each of the die blocks in the pluralities 16 and 18 of die blocks has an internal cavity 20 the use of which will shortly become apparent. Each of the die blocks further has generally opposed outer surfaces, i.e., the outer surfaces 22 on the die blocks 16 and the outer surfaces 24 on the die blocks 18. The opposed outer surfaces 22 and 24 serve for receiving and substantially surrounding a first plurality of selected portions (generally the journal and bearing surfaces) of a work piece such as the crankshaft 26 when the platens 12 and 14 are moved towards each other. A plurality of relatively small fluid passageways 28 are provided extending through the opposed surfaces 22 and 24 of the die blocks 16 and 18. The passageways 28 provide fluid communication with the die blocks internal cavities 20.

A plurality of opposed fixtures, in the embodiment illustrated the end caps 30 are provided which are movable together relative to the platens 12 and 14. The end caps 30 serve to hold the crankshaft 26 at its ends 31 between the die blocks 16 and 18. The end caps 30 have studs 32 internally thereof as shown in FIG. 4 which fit within wells 33 in flanges 34 at the ends 31 of the crankshaft 26. The wells 33 and the corresponding mating studs 32 are offset from the center of the crankshaft 26 to prevent rotation thereof when held between the end caps 30. Means are provided for controllably pressuring the end caps 30 towards one another. This is important to insure that a relatively low pressure can be applied when the hot crankshaft 26 is held between said end caps 30 and that this pressure can be significantly increased during quenching to prevent axial distortion of the crankshaft 26. In the embodiment illustrated the pressuring means comprise the hydraulic cylinders 35 illustrated in FIG. 2 which allow a desirably fast, nearly instantaneous, pressure increase, e.g., from about 100 psi to about 1000 psi on quench startup.

In the embodiment illustrated a plurality of upward facing members such as V-blocks 36 (generally at least three when the workpiece is irregularly shaped, e.g., when it is the crankshaft 26) adjustably positioned upon a guide structure 37 are provided for holding the hot soft crankshaft 26 intermediate its ends 31 and between the die blocks 16 and 18 in position for grasping by the end caps 30 under the impetus of the opposed hydraulic cylinders 35. Generally, it is preferred that three V-blocks 36 be used so as to provide proper support for the crankshaft 26 and at the same time minimize contact area therewith. Means, for example, the hydraulic cylinders 40 is generally provided for quickly lowering the guide structure 37 along with the V-block 36 to below the level of the die blocks 16 and 18 and further below the levels of the platens 12 and 14. In operation, the hot soft crankshaft 26 sits only momentarily on the V-block 36; the end caps 30 quickly grasp the ends 31 of said crankshaft 26 and the V-blocks 36 and guide structure 37 are quickly lowered. This virtually eliminates softening problems at the points of contact of the V-blocks 36 with the crankshaft 26. The guide structure 37 as will be apparent from FIG. 2 includes a plurality of tracks 41 in which the V-blocks 36 are movable to provide for adjustment for different size and shape crankshafts 26.

The apparatus of the present invention generally includes a flange 44, extending from the platen 14. The flange 44 extends towards the platen 12 and contacts the platen 12 when the platens are moved towards each other to form a chamber about the crankshaft 26. Quench means, for example, lines 46 extending from quench valve means, for example, a valve 48 serve to introduce fluid to each of the die block internal cavities 20. More particularly, the fluid is introduced via the lines 46 into the platens 12 and 14 and passes through a plurality of chambers 50 therein to the internal cavities 20 of the die blocks 16 and 18.

Also an important part of the apparatus is means for moving the end caps 30 with the crankshaft 26 held therebetween towards the stationary platen 12 at such a rate that the crankshaft 26 is grasped generally simultaneously by the die blocks 16 and 18. In the embodiment illustrated said moving means comprises a pair of linear screw actuators 52 as illustrated in FIG. 2. Each of the actuators 52 are driven by a hydraulic motor 54 and react against a stationary threaded member 56 to translate the end caps 30 toward or away from the fixed platen 12. A pair of stops 58 are adjusted to limit the travel of the end caps 30. The output of the hydraulic motor 54 is controlled so that the end caps 30 travel at about half the rate of the movable platen 14. This assures that the crankshaft 26 is in position to be quenched in a desired manner as soon as the die blocks 16 and 18 contact the crankshaft 26. Thus, slow cooling of the crankshaft 26 by contact with the die blocks 16 and 18 is prevented.

The apparatus further includes flood conduit means such as the flood lines 60 along with valve means, for example a flood valve 62 for controlling fluid flow through the flood lines 60 via which the chamber formed about the crankshaft 26 is filled with fluid, generally water. The length of the flood lines 60 are generally equal so as to flood the chamber at the same time at each end thereof.

In the preferred embodiment of the invention as illustrated in FIG. 3, the apparatus includes a plurality of gas (generally air) anneal fixtures 64 which extend from the platens 12 and 14 generally towards a second portion (generally a plurality of counterweight 66) of the crankshaft 26. Usually the gas anneal fixtures 64 are shaped to match the shape of the counterweights 66 and are arranged to be slightly spaced therefrom when the platens 12 and 14 are together forming a chamber about the crankshaft 26. The gas anneal fixtures generally include therewithin a cavity 68 which receives gas under pressure from a gas supply 70. A plurality of small gas passageways 72 proceed from the cavity 68 to a surface 74 of the gas anneal fixture 64 which faces an adjacent counterweight 66. The gas anneal fixtures 64 are not illustrated in FIG. 2 to avoid excessive crowding in that figure.

As will be noted by reference to the drawings, the quench means or more specifically the quench lines 46 are generally substantially equal in length so as to control the flow of fluid to be substantially simultaneous to each of the die block cavities 20 of the die blocks 16 and 18. This is important in that it assures an equal hardening of the crankshaft on each side thereof. Since at least one of the platens, namely the platen 14, must be movable relative to the other platen, namely the platen 12, line length adjusting means such as a slip joint 76 must be provided in the quench lines 46 leading to the movable platen 14 whereby all of the quench lines 46 become of equal length on closing of the apparatus 10 about the crankshaft 26.

The die blocks 16 and 18, as will be noted generally include work piece supports or pads 78 extending therefrom, said pads 78 being shaped for minimal surface contact with the work piece. For example, the pads 78 will generally be flat and since the work piece will generally be cylindrical in shape this will lead to generally a line contact between each pad and each cylindrical work piece. It is of course clear that other shapes of the pads 78 may be utilized to assure minimal surface contact or the pads 78 may be replaced with other structures which will still lead to minimal surface contact with the crankshaft 26. It is important to maintain the surface contact with the crankshaft 26 to be minimal so as to assure that the cooling of each part of crankshaft 26 is substantially equal. If a large surface contact were maintained between the crankshaft 26 and the pads 78 as for example by making said pads matingly cylindrical to the work piece then a substantial portion of the crankshaft 26 would be cooled at a slower rate since it would be protected from the quench fluid by its contact with the pads 78.

OPERATION

Turning now to the operation of the apparatus of the present invention and to the die quenching method of the present invention it is clear that this consists of holding a softened heated work piece, for example the crankshaft 26 under a pressure insufficient to cause distortion thereof between a pair of fixtures, for example the end caps 30. Typically the pressure used will be about 100 psi. Because of the relatively high temperature and concurrent softness of the heated crankshaft, which generally will have come directly from a furnace or the like, high pressure between the end caps 30 would lead to distortion in the shape of the crankshaft 26. A chamber is then formed about the crankshaft 26 with the die blocks 16 and 18 extending into the chamber supporting the crankshaft 26 and preventing distortion thereof. Once the crankshaft 26 is supported in the chamber by the die blocks 16 and 18 the pressure between the end caps 30 is increased sufficiently to prevent the work piece from forcing them further apart as it is quenched. This is important to assure that the crankshaft 26 maintain its desired size and shape. A quench liquid is sprayed through the plurality of small passageways 28 in the die blocks 16 and 18 on to first selected portions of the crankshaft 26 very quickly after the die blocks 16 and 18 contact the crankshaft 26. Substantially zero contact time between die blocks 16 and 18 and the crankshaft 26 is contemplated and preferred before quenching starts. These first selected portions comprise those portions of the crankshaft 26 which it is desired to have hardened the most, generally the journal and bearing surfaces thereof. The quench liquid spraying and the increase in pressure on the end caps 30 is generally substantially simultaneous to prevent distortion of the crankshaft 26. The chamber is then flooded with quench liquid whereby hardening of the rest of the crankshaft can take place.

In a preferred embodiment of the invention during the above-mentioned spraying and flooding pressurized gas is blown through a plurality of small openings, e.g., the gas passageways 72, into the chamber and on to second selected portions of the crankshaft 26, generally on to the counterweight 66 thereof. The pressurized gas thereby keeps these second selected portions of the crankshaft from being hardended as much as the rest of the crankshaft is hardened. After the crankshaft 26 is removed from the die quench apparatus 10 following the quenching operation carried out thereon the second selected portions of the crankshaft 26 are more machinable. It will be noted that the ends 31 of the crankshaft 26 are generally protected by the end caps 30 from the quenching which occurs within the chamber whereby said ends 31 of the crankshaft 26 remain considerably softer than the rest of the crankshaft 26 and can be machined as desired While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. Die quenching apparatus, comprising:

1. a pair of relatively horizontally movable opposed platens;
2. a plurality of die blocks supported on the first of said platens;
3. a corresponding plurality of die blocks supported on the second of said platens for cooperation with said first platen and die blocks, said first and second die blocks each having an internal cavity and further having generally opposed outer surfaces for receiving and substantially surrounding a first plurality of portions of a work piece when said platens are moved towards each other;
4. a plurality of relatively small fluid passageways extending through the opposed surfaces of said die blocks, said passageways providing fluid communication with said die block cavities;
5. a plurality of opposed fixtures movable together relative to said platens for holding said work piece at its ends in said die blocks;
6. means for moving said opposed fixtures wih said work piece held therebetween and at least one of said platens relative to one another at such a rate that said work piece is grasped substantially simultaneously by said first and second platen supported die blocks;
7. quench means for introducing fluid to each of said die block cavities substantially simultaneously with said grasping of said work piece by said first and second platen supported die block; and
8. means for pressuring said fixtures towards one another.

2. Apparatus as in claim 1 wherein said platens are substantially vertical.

3. Apparatus as in claim 2, including:

9. a plurality of upward facing members for holding said work piece intermediate its ends between said die blocks in position for grasping by said opposed fixtures; and
10. means for lowering said plurality of members to below the level of said die blocks.

4. Apparatus as in claim 3, including flange means extending from a respective one of said vertical platens towards a respective other of said platens, said flange means forming a chamber about said work piece when said platens are moved to their closest proximity.

5. Apparatus as in claim 4, including flood conduit means in fluid communication with said chamber and valve means for controlling fluid flow through said flood conduit means.

6. Apparatus as in claim 5, including a plurality of annealing fixtures each including a plurality of relatively small gas passageways therethrough opening into said chamber adjacent a second plurality of portions of said work piece and means for supplying a pressurized gas to said gas passageways.

7. Apparatus as in claim 6, wherein said quench means includes means for controlling flow of fluid to be substantially simultaneous to each of said die block cavities.

8. Apparatus as in claim 7, wherein said die blocks include work piece supports extending therefrom, said supports being shaped for minimal surface contact with said work piece.

* * * * *